US006655156B1

(12) United States Patent
Miksic et al.

(10) Patent No.: US 6,655,156 B1
(45) Date of Patent: Dec. 2, 2003

(54) BIODEGRADABLE CRYOGENIC BAG

(75) Inventors: Boris A. Miksic, North Oaks, MN (US); Robert A. Boyle, Oakdale, MN (US)

(73) Assignee: Cortec Corporation, St. Paul, MN (US)

( * ) Notice: Subject to any disclaimer, the term of this patent is extended or adjusted under 35 U.S.C. 154(b) by 0 days.

(21) Appl. No.: 10/231,807

(22) Filed: Aug. 28, 2002

(51) Int. Cl.[7] ..... F17C 7/04; F17C 9/02; F17C 1/00; F17C 13/00; F17C 3/00

(52) U.S. Cl. ..... 62/48.1; 62/46.1; 220/560.04; 220/560.08

(58) Field of Search ..... 62/48.1, 371, 46.1, 62/45.1; 220/560.04, 560.08

(56) References Cited

U.S. PATENT DOCUMENTS 3,659,543 A * 5/1972 Basile et al. ..... 114/74 A
4,101,045 A * 7/1978 Roberts et al. ..... 220/560.12
4,796,676 A * 1/1989 Hendershot et al. ..... 141/83
5,267,852 A * 12/1993 Mizuno ..... 431/203
5,934,495 A * 8/1999 Chiodo ..... 220/257.2
6,083,621 A * 7/2000 Sugimoto ..... 428/378
6,156,929 A * 12/2000 Chandler et al. ..... 562/582

* cited by examiner

*Primary Examiner*—William C. Doerrler
(74) *Attorney, Agent, or Firm*—Haugen Law Firm PLLP

(57) ABSTRACT

A vessel for retaining cryogens in the form of a flexible liner for compliably retaining a cryogen and designed for controlled release of vapors generated by the cryogen. The improved flexible liner is biodegradable, with the incorporation of the biodegradable component within the resin being accomplished without adversely affecting the properties of the film at cryogenic temperatures. A preferred biodegradable film consists of a polyester comprising butane 1,4-diol and adipic acid to which a controlled quantity of terephthalic acid has been added.

11 Claims, 1 Drawing Sheet

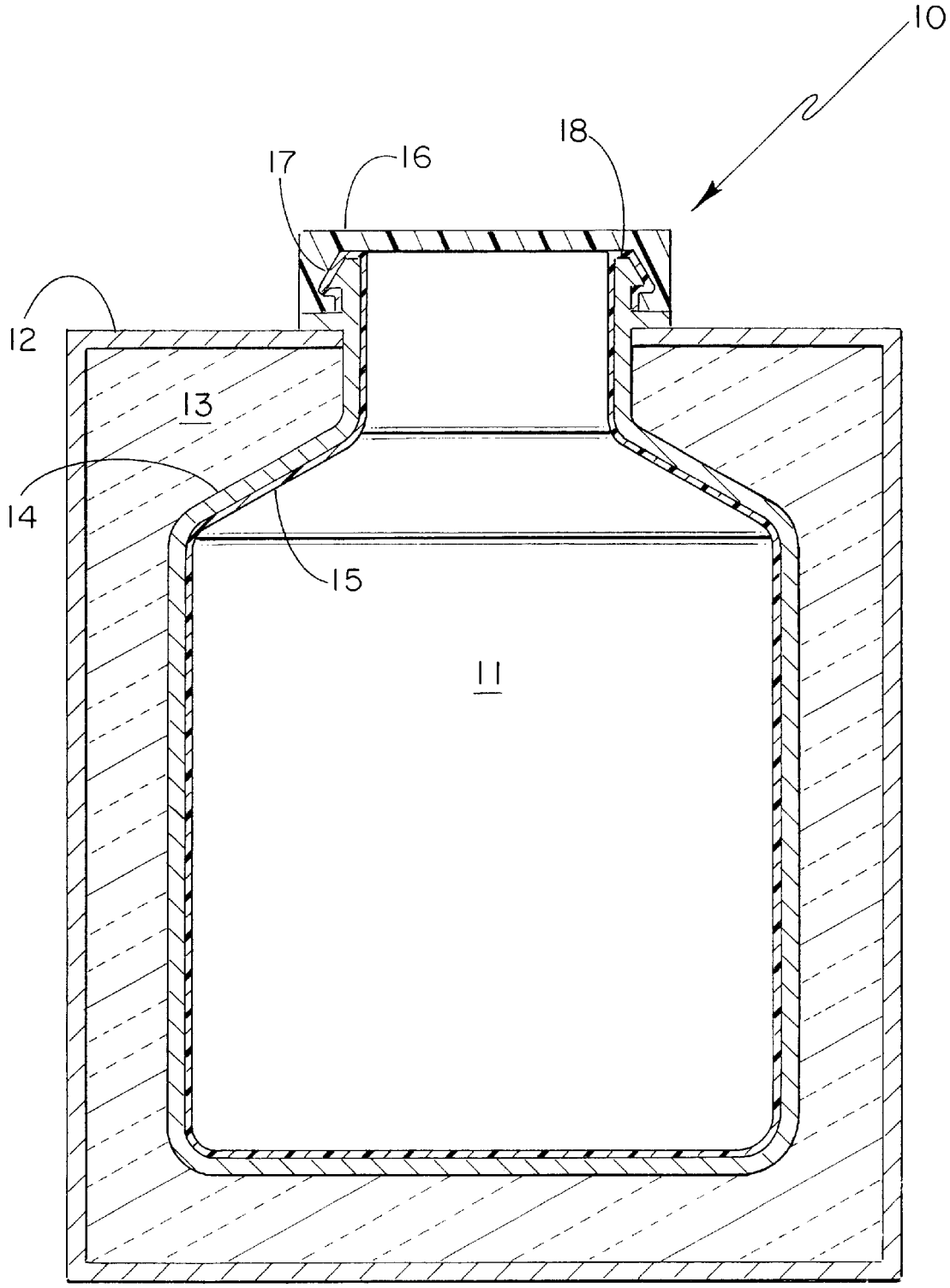
10
18
17
16
12
13
14
15
11

BIODEGRADABLE CRYOGENIC BAG

BACKGROUND OF THE INVENTION

The present invention relates generally to an improved vessel for retaining cryogens, and more particularly to an improved flexible liner for compliably retaining a cryogen preferably within a generally rigid walled vessel. The flexible liner selected for the application are biodegradable polyester resins which possess the property of retaining flexibility at cryogenic temperatures as low as −210° C. Biodegradable polyester resins of this type are commercially available.

Cryogenic vessels are widely used for a variety of applications, such as, for example, in applications for the packaging of frozen foods as well as for maintaining a low temperature ambient for transfer or shipping of articles including cryogens per se. Typical cryogens include, by way of example, liquid nitrogen, liquid air, liquified natural gas (LNG), and the like.

Because the volume of the film utilized in cryogenic applications is exceptionally large, it is desirable to utilize a material which possesses the physical properties required for the application, and at the same time, is biodegradable. A number of materials, while applicable for use as cryogenic liners are not suited for this application, inasmuch as the addition of biodegradable components may cause a deterioration of the physical properties of the film, thereby rendering it unsuited for the application. In addition, certain film components provide a limitation upon certain applications, particularly those in which direct and/or incidental contact with food is reasonably expected or anticipated.

SUMMARY OF THE INVENTION

In accordance with the present invention, flexible polyester liners have been developed which are biodegradable, and at the same, retain flexibility at cryogenic temperatures typically as low as about −210° C. Such temperatures are, of course, compatible with cryogens such as liquid nitrogen (−210° C.), liquid air (−200° C.), liquified natural gas (LNG) (−182° C.), as well as others such as solid carbon dioxide (dry ice). Several suitable biodegradable polyester resins are commercially available. One preferred resin is available commercially under the trade designation "FBX-7011" available from BASF of Parsipanny, N.J. Other suitable resins include a "Tone" polymer, commercially available from the Union Carbide arm of Dow Chemical Co. under the trade designation "P-787". An alternative polyester resin is available from Showa Denko of Japan under the trade designation "Bionolle", and carrying the numerical suffix "3001". A further alternative resin that is useful for certain cryogenic applications is available from Eastman Chemical of Rochester, N.Y. under the trade designation "Eastar". Polyesters suitable for use in connection with the present invention may also be prepared as the reaction product of a butylene diol such as 1,3-butylene glycol with a dibasic aliphatic acid to which a small quantity of an aromatic polyacid has been added to form mostly linear aliphatic polyesters useful in connection with the present invention.

In a typical application, the flexible biodegradable polyester film prepared from these resins is formed into a configuration to fit within a generally rigid walls of a cryogenic vessel. The walls are typically formed of a thin metallic sheet, and reinforced or supported by a durable but effective thermal insulation. Closed-cell polyurethane foam has been found to be useful in this regard, although other foams may be utilized as well. The entire insulation foam/metallic inner shell is placed within a more durable and rigid metallic outer shell for ease of handling and protection against damage due to impact and the like.

The cryogenic vessel may assume any of the normal configurations employed for these purposes. The description given herein is provided for ease in understanding the invention, and is not intended as a limitation upon the scope to which the invention is entitled.

Inasmuch as the volume of flexible film material utilized for cryogenic liners is large, and inasmuch as these materials are not readily reusable, particularly if employed in the food industry, their disposal is enhanced when the biodegradable feature is added. The utilization of biodegradable liners will serve to effectively reduce the need for landfill type disposal and the like, thereby providing an added measure of protection for the environment.

Therefore, it is a primary object of the present invention to provide an improved flexible liner for compliably retaining a cryogen within a cryogenic receiving vessel, wherein the flexible liner is a biodegradable polyester film which remains flexible at cryogenic temperatures as low as about −210° C.

It is a further object of the present invention to provide an improved vessel adapted for receiving cryogens and adapted for controlled release of the cryogen in gaseous or liquid state, with the flexible liner compliably retaining the cryogen within the walls of a rigid vessel and being biodegradable and remaining flexible at cryogenic temperatures as low as about −210° C.

Other and further objects of the present invention will become apparent to those skilled in the art upon a study of the following specification, appended claims, and accompanying drawings.

IN THE DRAWING

The figure is a vertical sectional view taken through the center portion of a vessel adapted for receiving cryogens, with the vessel being provided with a flexible liner for compliably retaining the cryogen within the vessel.

DESCRIPTION OF THE PREFERRED EMBODIMENT

In accordance with the preferred embodiment of the present invention, and as illustrated in the figure, the vessel generally designated 10 is adapted for receiving and retaining cryogens, and is also adapted for the controlled release of a quantity of the retained cryogen. Vessel 10 comprises a cryogenic chamber 11 defined within a multi-walled vessel assembly including an outer metallic shell 12 surrounding a layer of thermal insulation 13. Insulation layer 13 preferably comprises a closed-cell resinous material such as, for example, polyurethane. Other suitable thermal barriers include, by way of example, foam polyethylene, foam polypropylene, and the like. A metallic inner shell 14 is positioned inwardly from the insulation layer 13, and serves to define the outer wall of chamber 11.

Liner 15 is provided as a flexible film liner and consists primarily of a biodegradable polyester film with the property of retaining flexibility at cryogenic temperatures as low as about −210° C. The biodegradable polyester film is biodegradable following exposure to cryogenic temperatures.

In actual use, the liner 15 is placed within the confines of metallic inner shell 14 and thereafter filled with the appropriate cryogen. At the upper portion of vessel 10 is a cap or lid member 16 which serves as a typical closure for the cryogenic vessel. The liner opening or mouth zone or portion 17 is typically folded over the neck/rim 18 of inner shell 14, as illustrated in the drawing.

In order to describe the features of the preferred and other embodiments of the present invention, the following specific examples are given:

EXAMPLE I

A biodegradable polyester with properties suitable for blown film extrusion is available from BASF of Germany under the trade designation "Ecoflex F BX 7011". This film is used to prepare liners for vessels containing cryogenic liquid nitrogen. The film may be used as a solid wrapping or as a ventilated pouch for solid carbon dioxide (dry ice) as well.

The resin for this biodegradable film consists of the polymeric reaction product of butane 1,4-diol and adipic acid to which a controlled quantity of terephthalic acid has been added, with the primary dicarboxylic acid component being adipic acid. Preferred densities of the reactant product range from 1.2 to 1.5 g/mm$^2$, and have a melting point ranging from 100°–130° C. Films with these properties have been found to be desirable for the cryogenic applications listed above.

EXAMPLE II

A biodegradable polyester with properties suitable for blown film extrusion is available from Showa Denka of Japan under the trade designation "Bionolle 3011". This film is formed as the reactant product of adipic acid, succinic acid, and butane diol. This film is used to prepare liners for vessels containing cryogenic liquid nitrogen. The liner bags or pouches which may be provided with venting holes are produced in rolls and separated in automatic operations, as they are loaded with the appropriately formed solid carbon dioxide (dry ice) blocks. The carbon dioxide filled pouches are used to keep food cold until consumed and can thereafter be shipped to composting sites for disposal.

EXAMPLE III

Liquid nitrogen is also widely used to preserve frozen forms of food and other perishable materials. Bags prepared as in Examples I and II remain flexible when filled with liquid nitrogen which can be used to preserve food at a lower temperature than is available from solid carbon dioxide (dry ice). These bags are vented to permit release of gaseous material from the cryogen.

By way of summary, the present invention provides additional utility in the utilization of more ecologically friendly biodegradable materials, including films utilized in food packaging which, when utilized, are ecologically more friendly than non-biodegradable films. Films prepared in accordance with the present invention perform well for their intended purposes. It will be further appreciated that the specific examples given herein are provided for purposes of illustration and for demonstrating the preferred manner of utilization. of the features of the present invention. Therefore, these examples are illustrative of the present invention and are not to be deemed a limitation upon the scope to which the invention is otherwise entitled.

What is claimed is:

1. In combination with a vessel adapted for receiving cryogens and adapted for the controlled release of a gaseous emission from a cryogen retained therewithin; a flexible liner for compliably retaining said cryogen within said vessel, said flexible liner being characterized in that:

(a) said flexible liner consists of a biodegradable polyester film with the property of retaining flexibility at cryogenic temperatures as low as about −210° C.;

(b) said biodegradable polyester resin being biodegradable following exposure to cryogenic temperatures.

2. The combination of claim 1 wherein said flexible liner is configured with at least one opening for the controlled release of said gaseous emission.

3. The combination of claim 1 wherein said flexible liner consists of the reaction product of butane 1,4-diol and a blend of adipic acid and an aromatic polyacid, with the reaction product having a density ranging from between 1.2 and 1.5 g/mm$^2$ and a melting point ranging from between 100 and 130° C.

4. The combination of claim 3 wherein said aromatic polyacid is terephthalic acid.

5. A flexible bag adapted for receiving cryogens and adapted for the controlled release of a gaseous emission from a cryogen retained therewithin; a flexible bag for compliably retaining said cryogen, said flexible bag being characterized in that:

(a) said flexible bag consists of a biodegradable polyester film with the property of retaining flexibility at cryogenic temperatures as low as about −210° C.;

(b) said biodegradable polyester film being biodegradable following exposure to cryogenic temperatures.

6. The flexible bag as defined in claim 5 wherein said flexible bag is configured with at least one opening for the controlled release of said gaseous emission.

7. The flexible bag as defined in claim 5 wherein said flexible bag consists of the reaction product of butane 1,4-diol and a blend of adipic acid and an aromatic polyacid, with the reaction product having a density ranging from between 1.2 and 1.5 g/mm$^2$ and a melting point ranging from between 100 and 130° C.

8. The flexible bag of claim 7 wherein said aromatic polyacid is terephthalic acid.

9. A flexible bag adapted for receiving cryogens and adapted for the controlled release of a gaseous emission from a cryogen retained therewithin; a flexible bag for compliably retaining said cryogen, said flexible bag being characterized in that:

(a) said flexible bag consists of a biodegradable polyester film consisting of the reaction product of butane 1,4-diol and a blend of adipic acid and an aromatic polyacid, with the reaction product having a density ranging from between 1.2 and 1.5 g/mm$^2$ and a melting point ranging from 100 and 130° C., said flexible bag retaining flexibility at cryogenic temperatures as low as about −210° C.;

(b) said biodegradable polyester film being biodegradable following exposure to cryogenic temperatures.

10. The flexible bag as defined in claim 9 wherein said flexible bag is configured with at least one opening for the controlled release of said gaseous emissions.

11. The flexible bag as defined in claim 9 wherein said aromatic polyacid is terephthalic acid.

* * * * *